US010279970B2

(12) United States Patent
Sohler et al.

(10) Patent No.: US 10,279,970 B2
(45) Date of Patent: May 7, 2019

(54) FLEXIBLE SAFETY CAP FOR ELONGATED OBJECTS

(71) Applicants: Wolfgang Sohler, Wangen-Neuravensburg (DE); Thiemo Roesler, Wangen-Neuravensburg (DE)

(72) Inventors: Wolfgang Sohler, Wangen-Neuravensburg (DE); Thiemo Roesler, Wangen-Neuravensburg (DE)

(73) Assignee: Roesler IP GmbH (DE)

( * ) Notice: Subject to any disclaimer, the term of this patent is extended or adjusted under 35 U.S.C. 154(b) by 0 days.

(21) Appl. No.: 15/265,140

(22) Filed: Sep. 14, 2016

(65) Prior Publication Data

US 2017/0073152 A1 Mar. 16, 2017

(30) Foreign Application Priority Data

Sep. 15, 2015 (DE) ..... 10 2015 011 768

(51) Int. Cl.
*B65D 85/20* (2006.01)
*B65D 59/06* (2006.01)
*B25H 3/00* (2006.01)

(52) U.S. Cl.
CPC ..... *B65D 59/06* (2013.01); *B25H 3/00* (2013.01)

(58) Field of Classification Search
CPC ..... B65D 59/06; B65D 85/20; B65D 85/24; B65D 85/28; B65D 25/107; B65D 25/105; B65D 25/102; B65D 25/101; B65D 61/02; B65D 2585/08; B25H 3/00; B25H 3/003
USPC .... 30/298.4, 296.1; 224/251, 250, 249, 247, 224/232; 206/825, 476, 485
See application file for complete search history.

(56) References Cited

U.S. PATENT DOCUMENTS

| | | | | |
|---|---|---|---|---|
| 4,984,793 | A * | 1/1991 | Chen | A63B 49/08 473/519 |
| 2004/0099553 | A1 | 5/2004 | Chen | |
| 2007/0228240 | A1 | 10/2007 | Kao | |
| 2009/0050658 | A1 * | 2/2009 | Boyd | A45C 1/06 224/245 |
| 2015/0101721 | A1 | 4/2015 | Roesler | |

FOREIGN PATENT DOCUMENTS

| | | |
|---|---|---|
| DE | 8810820 | 10/1988 |
| DE | 29507882 | 9/1995 |
| DE | 9410538 | 10/1995 |
| DE | 202012000372 | 4/2013 |

* cited by examiner

*Primary Examiner* — Allan D Stevens
(74) *Attorney, Agent, or Firm* — Cohen & Grigsby, PC

(57) ABSTRACT

Flexible safety cap for clamped holding of elongated objects is disclosed. The safety cap includes an elastically deformable packaging that is open on at least one end and consists of two opposing side walls, a bottom wall, a cover wall and an end wall, wherein multiple slots spaced a distance apart from one another are arranged at least in the cover wall and/or in the bottom wall, forming upper and/or lower strap-shaped or belt-shaped spring elements between them, the spring elements thus forming a clamping channel to hold an elongated object.

15 Claims, 6 Drawing Sheets

FLEXIBLE SAFETY CAP FOR ELONGATED OBJECTS

FIELD OF THE INVENTION

The invention relates to a flexible safety cap of elastically deformable packaging for clamped holding of elongated objects. The flexible safety cap is open on at least one end and includes two opposing side walls, a bottom wall, a cover wall and an end wall.

BACKGROUND OF THE INVENTION

A flexible safety cap for receiving at least one tool or one other object with various diameters has become known from DE 10 2013 017 140 A1; it works with at least one clamping profile that acts in the clamping opening from an end wall and an opposing clamping opening.

The clamping connection is established between an outside circumference of the tool and an inside wall of the safety cap because the clamping profile is designed to be out-of-round, and the entire flexible safety cap can be reshaped into a round cross section by elastic deformation of an out-of-round cross section.

For clamping accommodation of a tool to be protected or of an object, the sleeve-type packaging is therefore shaped from an oval cross section into a round cross section by finger pressure on one hand, and in this position, the object to be protected is inserted into the package and then the deforming pressure is removed, so that the package springs back to its original state.

Thus the object to be protected or at least its tip to be protected is held in the interior of the packaging by clamping of the opposing side walls in the resting state.

Packaging for clamping accommodation of sharp-edged objects in which multiple inclined retaining webs run from one side to the other above a base level of the packaging and/or a base plate is known from DE 88 10 820 U1; the retaining webs serve only to secure the position of the object to be held but do not exert a clamping effect. The clamping occurs only on the shaft of a blade to be accommodated there with the side walls of the protective packaging.

SUMMARY OF THE INVENTION

The invention is therefore based on the object of refining a protective packaging for accommodating objects of different diameters according to DE 10 2013 017 140 A1 so that very small elongated objects can be held securely in the diameter.

To solve the problem as formulated, the present invention is characterized by the technical teaching of a flexible safety cap for holding elongated objects, the flexible safety cap comprising: a first side wall having a front edge and a back edge; a second side wall having a front edge and a back edge, said second side wall being arranged oppositely from said first side wall; a first clamping wall having a front edge and a back edge, said first clamping wall defining an array of spring elements with a slot between each of the spring elements in said array of spring elements, each spring element in said first clamping wall being elastically deformable and having a first end that is connected to said first side wall and a second end that is connected to said second side wall, each said spring element also having a reduced cross-section adjacent to said first side wall that defines a first spring part and a reduced cross-section adjacent to said second side wall that defines a second spring part; a second clamping wall that has a front edge and a back edge, said second clamping wall being arranged oppositely from said first clamping wall, said second clamping wall being connected to said first side wall and also being connected to said second side wall, said second clamping wall cooperating with the spring elements of said first clamping wall to define a clamping channel between the spring elements of said first clamping wall and said second clamping wall, said first and second spring parts of said spring element diminishing bending of the spring element between said first and second spring parts in response to the insertion of an object into said clamping channel; and an end wall that is connected to the back edge of said first side wall and that is also connected to the back edge of said second side wall.

The feature of the invention is that the protective packaging now consists essentially of a bottom wall (i.e., second clamping wall) connected to lateral opposing side walls (i.e., first and second side walls) which are completed by an end wall on one side (i.e., at back edge of the first and second side walls). At least in the cover wall (i.e., first clamping wall), slots are formed at a mutual spacing transversely to the direction of insertion of an object to be held, wherein the slots define upper spring elements that are formed from the material of the cover wall.

In this first embodiment, the bottom wall parallel to the cover wall may be designed to be smooth. It is therefore not necessary according to the solution to also arrange the spring elements in the area of the bottom wall.

In a preferred second embodiment it is provided that the spring elements which are divided by slots are present in both the cover wall and in the bottom wall.

Additional spring elements, which are also divided by slots, are thus provided on the top side of the opposing side walls, assuming a mutual distance from one another, wherein the spring elements on the bottom side and the spring elements on the top side are offset relative to one another with a gap in the longitudinal direction of the packaging.

To simplify the description, it is assumed in the following description that spring elements divided from one another by slots running transversely are present in both the cover wall and in the bottom wall, although the invention is not limited to this.

With the given technical teaching this yields the advantage that a safety cap is proposed in which objects of different geometries, profile shapes and diameters can be held because the clamping or spring elements formed in the upper and lower levels are in friction-locking contact with the surfaces of the object being clamped with elastic spring action and elastic deformation.

Experiments have shown that very thin objects can be held securely in such a safety cap consisting of flexible spring elements in the range of 0.5 to 0.9 mm for example. These are thus flexible strap-shaped spring elements which form two different horizontal levels and are each offset relative to one another in the horizontal direction with respect to the upper and lower planes.

In a preferred embodiment, such a flexible safety cap is manufactured from an elastomeric plastic, such as a thermoplastic elastomer, for example, by the plastic injection molding method in one piece at the factory. For easier shaping, it is then provided that the clamping gap between the upper and lower spring elements which are offset relative to one another with a gap are formed from mutually interlocking mold halves.

An internal core may be omitted with the plastic injection mold used here.

The spring elements of the upper level which are offset from one another with a gap in comparison with the spring elements of the lower level thus form, in the direction of insertion of the object to be inserted, a clamping gap, which may be set at a clamping dimension of zero, for example, or the clamping dimension may also be designed to be negative, i.e., overlapping.

In a special embodiment it is provided that the spring elements each have beveled insertion bevels in the insertion direction in order to be able to more easily insert the object to be held.

The invention is not limited to holding a single elongated object although that is illustrated in the drawings.

Parallel objects arranged side-by-side may also be inserted into such a flexible safety cap and it does not matter which profile the object to be protected has. The profile may be designed to be round, oval, polygonal or multi-sided.

Such a flexible safety cap also serves for example to hold the blades of scalpels or to hold a Kirschner wire.

The core of the invention thus lies in the fact that mutually offset upper and lower spring elements are present, forming a clamping gap in the insertion direction for elongated objects to be held there. The clamping gap or clamping channel is formed by elastomeric layers or clamping surfaces offset from one another. It is preferable if the clamping surfaces sitting on the object to be held form inclined surfaces in the clamping channel in the unshaped condition.

However as soon as the object is inserted into the individual clamping slots formed between the upper and lower spring elements, these clamping surfaces or contact surfaces undergo elastomeric deformation so that they are in contact with the surface of the object to be inserted over the largest possible area.

Because of the fact that the strap-shaped spring elements are connected on both sides of the side walls of the flexible safety cap, each spring element can bend or deform upward and downward (perpendicular to the longitudinal extent of the object) and can also twist, i.e., its longitudinal extent rotates about a transverse axis of the safety cap.

The spring elements thus form spring straps bound at both ends to the opposing side walls which can thus bend upward and downward like a flexible elastomer as well as being pivotable. They can therefore move, undergo deformation and also tilt over.

In a simplified embodiment of the flexible safety cap it is sufficient to use two spring elements that are offset relative to one another with a gap, wherein starting from a bottom wall on the insertion side which serves as a supporting surface, an upper spring element therein and an upper spring element thereon may be connected therein and thereon with an offset and a gap. The clamping channel thereby formed is short.

As more spring elements form the upper and lower clamping levels at a mutual distance, the better is the hold of the object to be held because a longer clamping channel is available.

Therefore, in a preferred embodiment, four upper spring elements are described in the upper fastening level while three lower spring elements are present opposite the former, offset with a gap.

On the one side, at the right and left of these three lower spring elements, there is a bottom wall serving as the support for the object, and on the opposite side, a support element, which also serves to provide support and may be attached to the end wall in one piece at the factory is present.

In the particular embodiment of the invention it is provided that the spring elements each have diminished bending in the area of their tie to the respective side wall of the housing of the safety cap. These are cross sections of reduced thickness (i.e., reduced cross-section) to offer a favorable resiliency beyond the clamping surfaces.

The subject matter of the present invention is derived not only from the subject matter of the individual patent claims but also from the combination of the individual patent claims with one another.

All the information and features disclosed in the documents, including the abstract, and in particular the three-dimensional embodiment depicted in the drawings, are hereby claimed as essential to the invention inasmuch as they are novel individually or in any combination in comparison with the prior art.

Inasmuch as individual subject matters are referred to as "essential to the invention" or "important," this does not mean that these subject matters necessarily must form the subject matter of an independent claim. This is determined only by the respective valid version of the independent patent claim.

The invention is explained in greater detail below on the basis of drawings, which illustrate just one means of embodiment. Additional features that are essential to the invention and advantages of the invention can be derived from these drawings and the description thereof.

DESCRIPTION OF A PRESENTLY PREFERRED EMBODIMENT

Figure 1:
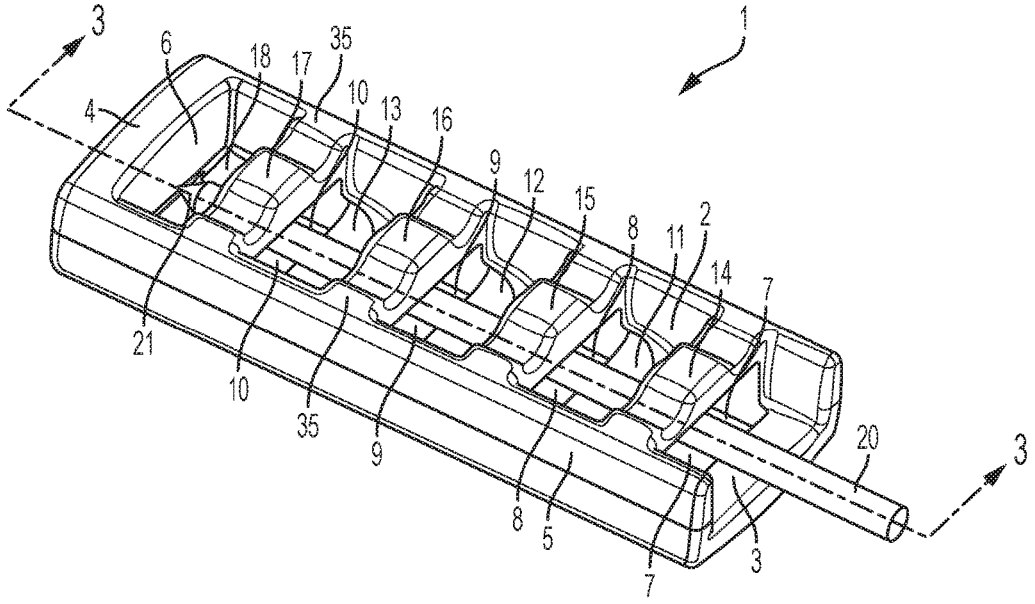
FIG. 1: shows schematically in a top view one embodiment of a flexible safety cap.
Figure 2:
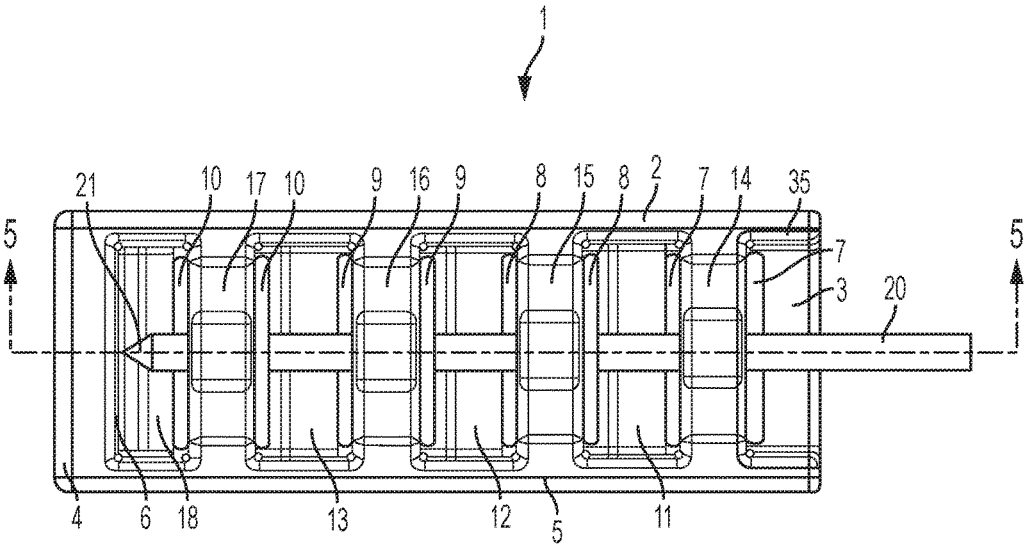
FIG. 2: shows the top view according to FIG. 1.

According to FIGS. 1 and 2, the flexible safety cap consists of an elastically bendable plastic element, in particular a thermoplastic material, and consists essentially of two opposing parallel side walls 2, 5 (i.e., first and second side walls) which are connected to one another by a bottom wall 3.

The cover wall 35 (i.e., first clamping wall) arranged opposite the bottom wall 3 (i.e., second clamping wall) and directed parallel to the bottom wall 3 is present only in rudimentary form, because it is permeated by slots 37-41 over its entire length and width, forming between them, from the material of the cover wall 35, the spring elements 14-17 of the upper clamping level.

However, the arrangement of parallel side walls is not necessary for solving this problem. They may also be designed to be conically diverging or converging relative to one another or may otherwise have any other shape.

Figure 3:
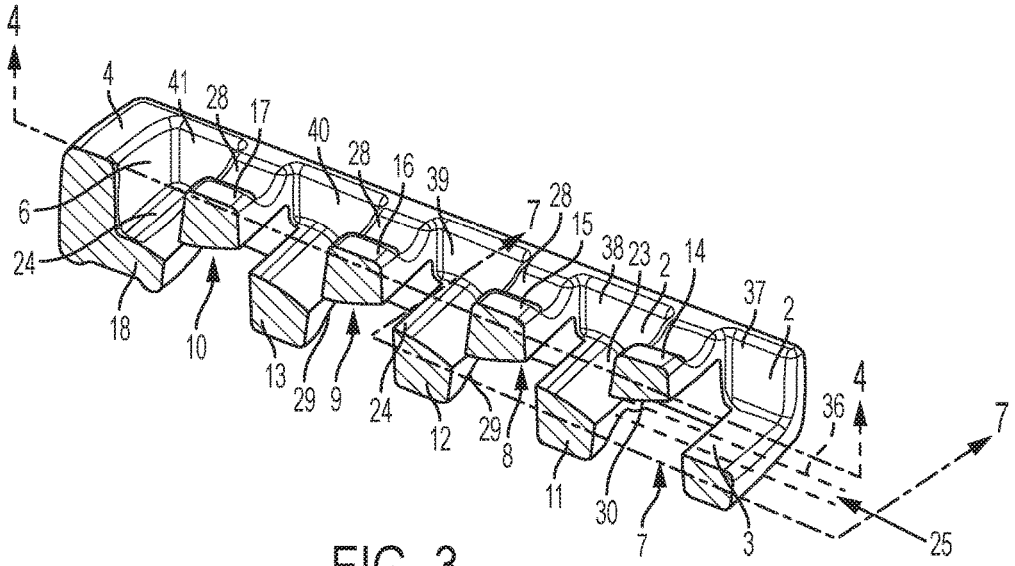
FIG. 3: shows a longitudinal section through the flexible safety cap in a perspective side view.

The bottom wall 3 according to FIG. 2 has regular slots 7, 8, 9, 10 running in the transverse direction to the longitudinal axis of the flexible safety cap 1 so that lower strap-shaped spring elements 11, 12, 13 parallel to one another and arranged a distance apart to one another are formed by the division of the slots (see FIG. 3).

Each spring element 11-13 is connected to the adjacent side walls 2, 5 in one piece at the factory and forms a continuous elastomeric part.

Upper strap-shaped spring elements 14, 15, 16, 17 having the same design in profile as the lower spring elements 11-13 are formed in the cover wall 35 at a vertical distance and offset with a gap from the lower spring elements 11-13. This means that these are strap-shaped or belt-shaped upper spring elements 14-17 which are connected to the side walls 2, 5 in one piece at the factory and have a bending-diminished cross section in the area of the respective tie to the respective side wall 2, 5, this weakening being referred to as the spring part 28 for the upper spring elements 14-17 and as spring part 29 for the lower spring elements 11-13, each having a first spring part adjacent the first side wall 2 and a second spring part adjacent the second side wall 5.

For clamping hold of an object 20 to be inserted in the insertion direction 25, the object is inserted into an clamping channel 36 (see FIG. 4), which is formed by the mutual vertical distance between the respective clamping surfaces of the lower spring elements 11-13 and the upper spring elements 14-17.

It is preferable if the slots 7-10 in the bottom wall 3 and the slots 37-41 in the cover wall 35 are parallel to one another and therefore form the strap-shaped or belt-shaped spring elements 11-13; 14-17. This construction results in the fact that the spring elements split off from the slots of the upper and lower levels are of the same width and have approximately a rectangular or quadratic profile.

However, if the slots 7-10 and 37-41 are designed to be crescent-shaped, conical or oval, then the spring elements 11-17 formed from them also have a crescent-shaped, oval or conical shape in the direction of the longitudinal extent.

Furthermore, it is preferable if the mutual spacing of the slots in the bottom wall 3 and the cover wall 35 is the same so that all spring elements arranged following one another in the longitudinal direction of the safety cap 1 have the same width and thus also create the same clamping force.

In another embodiment, however, it may be provided that the mutual spacing of the slots 7-10; 37-41 is to be altered progressively over the longitudinal extent of the safety cap 1. The spring elements 14, 15 and 11, 12 arranged closer to the insertion side may then assume a greater distance from one another than comparatively the spring elements 16, 17 and 12, 13 arranged next to the end wall 4. Therefore, the clamping force of the spring elements initially becomes less on insertion of an object 20 to be clamped into the clamping channel 36 and increases progressively with an increase in the insertion length.

The reverse case is likewise possible, namely that the spring elements 14, 15 and 11, 12 arranged closer to the insertion side may then assume a smaller distance from one another than comparatively the spring elements 16, 17 and 12, 13 arranged next to the end wall 4. Therefore, the clamping force of the spring elements becomes weaker from the insertion side in the direction of the pointed side of the support element 18.

To facilitate the insertion of the object 20 with its tip 21 it is provided that the foremost insertion bevel 30 at the forward end has a larger insertion angle than the insertion bevels 22, 23 of the other spring elements 11-17, which have less inclined insertion bevels 22 (top) and 23 (bottom).

Essentially the object 20 to be held is supported with its rear surface on the support member or support level 24 of the bottom wall 3 and sits with its tip 21 on a front support element 18, which is a continuation of the bottom wall 3 and is connected to the end wall 4.

In a preferred embodiment, it may be provided that friction-increasing ribs are also arranged on the clamping surfaces in addition. The clamping surfaces may also be roughened or provided with nubs or some other profiles.

In a preferred embodiment of the invention, it is provided that the respective clamping surface of the upper and lower spring elements 11-17 forms an insertion bevel 22, 23, which, however, does not extend continuously over the total clamping length but instead develops into a straight surface 26, 27 over a short distance.

The spring capacity of spring elements 11-17 is improved in this way, as will be show later with reference to FIG. 8.

Figure 6:
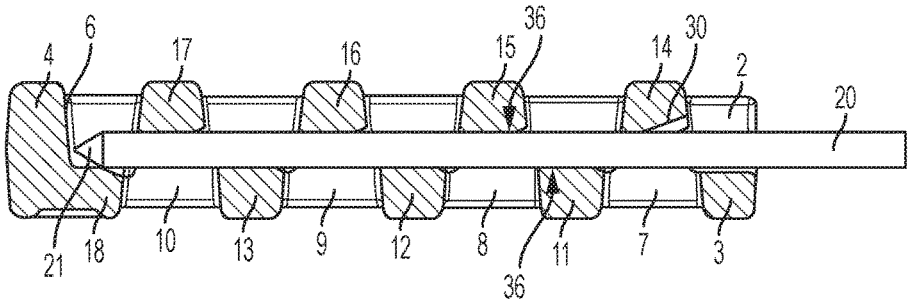
FIG. 6: shows a side view of the configuration according to FIG. 5.

FIG. 6 shows that the clamping surfaces of the spring elements 11-17 are designed, so that—except for the foremost insertion bevel 30—they lie in contact against the side of the object 20 to be held over practically the entire surface.

Figure 7:
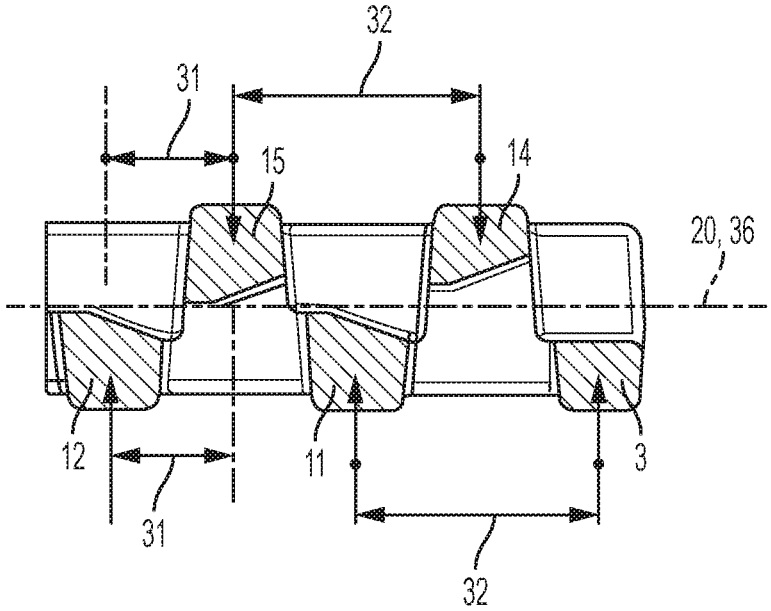
FIG. 7: shows schematically the geometric relationships of the spring elements of the upper and lower clamping levels forming inflection points.

FIG. 7 shows the geometric ratios where it is apparent that the lower spring elements are represented only schematically by (support) arrows (spring elements 12, 11) and spring elements 11, 12 which are the lower elements to the former, the upper spring elements 14, 15 are offset relative to the lower spring elements 11, 12 with a gap. The gap spacing is referred to as the offset distance 31.

The mutual spacing 32 between the upper and lower spring elements 11-17 should be the same in this embodiment.

Figure 8:
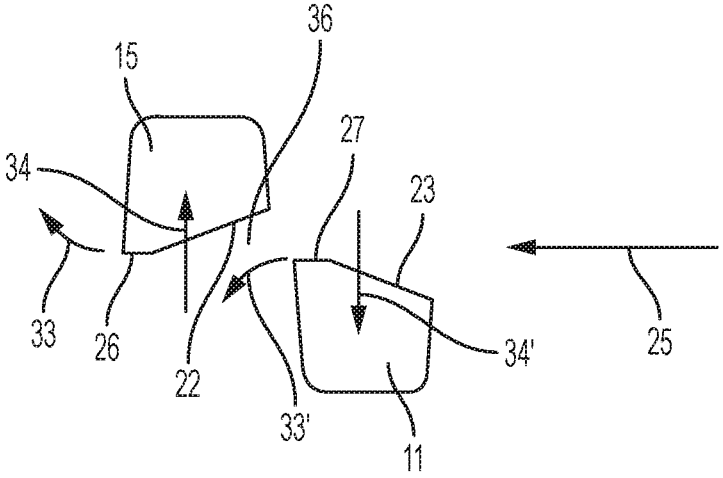
FIG. 8: shows the elastic deformation of the upper and lower spring elements on insertion of an object in a schematic diagram.

FIG. 8 shows that elastic deformation of the spring elements 11-17 occurs in various directions when the object 20 is inserted in the insertion direction 25. It runs first onto the respective insertion bevels 22, 23 of the respective upper and lower spring elements, the insertion bevels each being inclined in the same direction, thereby creating a contact pressure in the direction of the arrow 34, 34'. At the same time the respective spring element 11-17 is bent in an arc in the direction of the arrow 34, 34' as shown and because of the insertion movement in the insertion direction 25, tilt the respective spring element 11-17 in the direction of the arrow 33, 33' away from a transverse axis to thereby bring the respective insertion bevel 22, 23 into contact with the surface of the object 20.

It is thus clear that the spring elements 11-17 have a spring capacity such that they can undergo elastomeric shaping, on the one hand, with their clamping surfaces on the surface of the object 20, but at the same time, because of their three-dimensional spring capacity and the tilting, the previous insertion bevels 22, 23 can also be in contact with the top side of the object while the object is being held now also as straight surfaces and thereby form a practically continuous clamping surface (i.e., straight clamping surface).

A high holding power, such as that not known previously, is thus created in an extremely small space.

The insertion movement of the object 20 in the insertion direction 25 is limited by the fact that the tip 21 is in contact with the stop wall 6 in the inserted state and the stop wall 6 is connected to the end wall 4.

Figure 4:
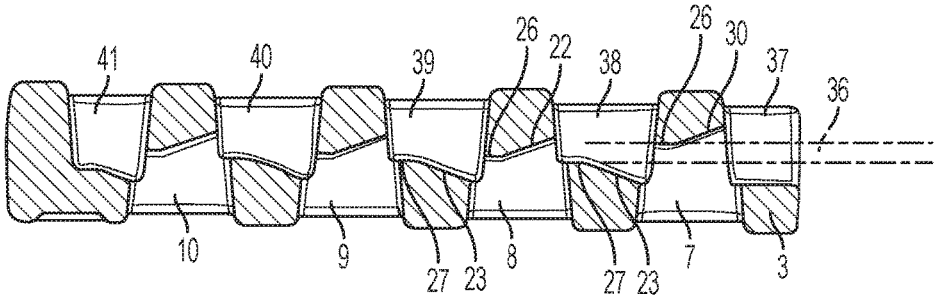
FIG. 4: shows the longitudinal section according to FIG. 3 in a side view.
Figure 5:
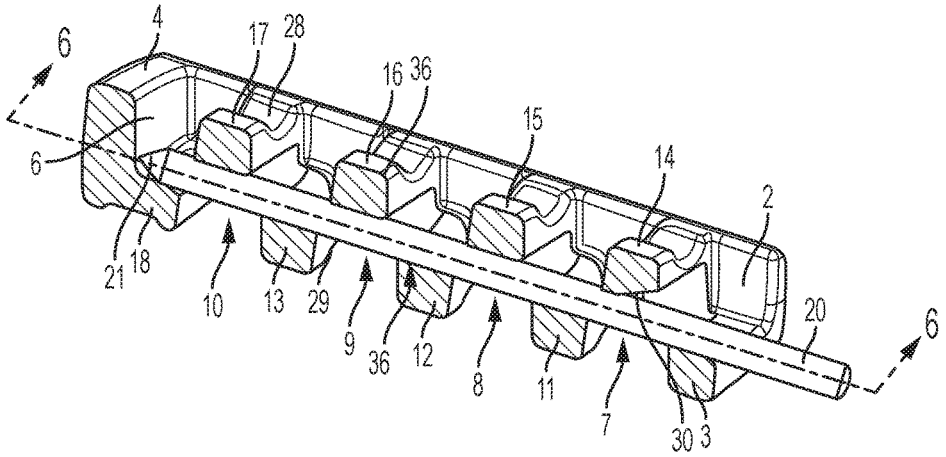
FIG. 5: shows a longitudinal section through the flexible safety cap with the object clamped in place in a perspective view.

It is apparent from FIG. 4 that the clamping channel 36 is positive, i.e., the straight surfaces 26, 27 of the upper and lower spring elements opposing one another form a mutually positive distance from one another.

In another embodiment however it may also be provided that the two surfaces 26, 27 are aligned in a longitudinal axis to one another so that the clamping channel 36 is returned back to the value zero.

Likewise, the straight surfaces 26, 27 may overlap so that there is even a negatively dimensioned clamping channel 36.

In a refinement of the invention, it may be provided that the flexible safety cap has side walls 2, 5, bottom wall 3, and end wall 4 that are elastically compressible, so that the clamping bond to the object held between the spring elements 11-17 can be loosened by finger pressure on the two opposing side walls 2, 5. By finger pressure the upper and lower spring elements 11-17 bulge upward, so that the object to be held can even be pulled out of the clamping gap, which has now opened, without resistance.

LEGEND TO THE DRAWINGS

1 flexible safety cap
2 side wall
3 bottom wall
4 end wall
5 side wall
6 stop wall
7 slot (lower)
8 slot (lower)
9 slot (lower)
10 slot (lower)
11 lower spring element
12 lower spring element
13 lower spring element
14 upper spring element
15 upper spring element
16 upper spring element
17 upper spring element
18 support element
20 object
21 tip
22 insertion bevel (upper)
23 insertion bevel (lower)
24 support level
25 insertion direction
26 straight surface (upper)
27 straight surface (lower)
28 spring part (upper)
29 spring part (lower)
30 insertion bevel (on 14)
31 offset distance
32 distance (upper)
33 direction of arrow 33'
34 direction of arrow 34'
35 cover wall
36 clamping channel
37 slot (upper)
38 slot (upper)
39 slot (upper)
40 slot (upper)
41 slot (upper)

What is claimed is:

1. A flexible safety cap for holding elongated objects, the flexible safety cap comprising:

a first side wall having a front edge and a back edge;

a second side wall having a front edge and a back edge, the second side wall being arranged oppositely from the first side wall;

a first clamping wall having a front edge and a back edge, the first clamping wall defining a first array of spring elements with a slot between each of the spring elements, each spring element in the first clamping wall being elastically deformable and having a first end that is connected to the first side wall and a second end that is connected to the second side wall, each spring element also having a reduced cross-section adjacent to the first side wall that defines a first spring part and a reduced cross-section adjacent to the second side wall that defines a second spring part;

a second clamping wall that has a front edge and a back edge, the second clamping wall being arranged oppositely from the first clamping wall, the second clamping wall being connected to the first side wall and also being connected to the second side wall, the second clamping wall cooperating with the first array of spring elements of the first clamping wall to define a clamping channel therebetween, the first and second spring parts of the spring element diminishing bending of the spring element between the first and second spring parts in response to insertion of an object into the clamping channel; and an end wall that is connected to the back edge of the first side wall and that is also connected to the back edge of the second side wall.

2. The flexible safety cap according to claim 1, wherein the flexible safety cap defines a longitudinal axis and wherein the spring elements have a shape that is an arc, an oval or a cone when viewed in a direction of the longitudinal axis such that the slots between said spring elements are crescent-shaped, conical or oval.

3. The flexible safety cap according to claim 1, wherein the second clamping wall further defines a front support element adjacent the front edge of the second clamping wall, the front support element being adapted to support objects that are clamped between the first clamping wall and the second clamping wall.

4. The flexible safety cap according to claim 1, wherein the second clamping wall further defines a support level adjacent the back edge of the second clamping wall, the support level being adapted to support objects that are clamped between the first clamping wall and the second clamping wall.

5. The flexible safety cap of claim 1, wherein the second clamping wall defines a second array of spring elements with a slot between each of the spring elements, each spring element in the second clamping wall being elastically deformable and having a first end that is connected to the first side wall and a second end that is connected to the second side wall.

6. The flexible safety cap according to claim 5, wherein the flexible safety cap defines a longitudinal axis, the spring elements of the second clamping wall being offset in a direction of the longitudinal axis from the spring elements of the first clamping wall.

7. The flexible safety cap according to claim 6, wherein the spring elements of the second clamping wall are parallel to the spring elements of the first clamping wall, wherein the spring elements of said first clamping wall and the spring elements of said second clamping wall form straight strap-shaped or belt-shaped spring elements.

8. The flexible safety cap of claim 7, wherein connections of the spring elements of the first clamping wall to the first and second side walls, and connections of the spring elements of the second clamping wall to the first and second side walls are formed by an integration of the spring elements with the first and second side walls.

9. The flexible safety cap of claim 6, wherein each of the spring elements of the second clamping wall has a reduced cross-section adjacent to the the first side wall to define a first spring part and a reduced cross-section adjacent to the second side wall to define a second spring part, the first and second spring parts of each spring element of the second clamping wall diminishing bending of the spring element between the first and second spring parts in response to the insertion of the object into the clamping channel.

10. The flexible safety cap according to claim 5, wherein the flexible safety cap defines a longitudinal axis, and a width of each slot between the spring elements of the first clamping wall, a width of each slot between the spring elements of the second clamping wall, a width of each spring element in the first clamping wall, and a width of each spring element in the second clamping wall is measured in a direction of the longitudinal axis of the flexible safety cap, and wherein the width of at least one slot between the spring elements of the first clamping wall is the same as the width of at least one other slot between the spring elements of the first clamping wall, the width of at least one slot between the spring elements of the second clamping wall is the same as the width of at least one other slot between the spring elements of the second clamping wall, and the spring elements of the first clamping wall and the spring elements of the second clamping wall all have the same width.

11. The flexible safety cap according to claim 5, wherein the flexible safety cap defines a longitudinal axis, and a width of each slot between the spring elements of the first clamping wall and a width of each slot between spring elements of the second clamping wall is measured in a direction of the longitudinal axis of the flexible safety cap, and wherein the width of the slots between the spring elements of the first clamping wall, and the width of the slots between the spring elements of the second clamping wall is altered progressively over an extent of the longitudinal axis of the flexible safety cap.

12. The flexible safety cap according to claim 5, wherein at least one of the spring elements in the first clamping wall further defines an insertion bevel that defines a surface that is inclined with respect to a longitudinal axis of the flexible safety cap, the incline of the surface being in a direction away from the front edge of the first clamping wall, and wherein at least one of the spring elements in the second clamping wall further defines an insertion bevel that defines a surface that is inclined with respect to the longitudinal axis of the flexible safety cap, the incline of the surface being in a direction away from the front edge of the second clamping wall.

13. The flexible safety cap according to claim 5, wherein the spring elements of the first clamping wall and the spring elements of the second clamping wall are elastically deformable upward and downward perpendicular to a longitudinal axis of an object inserted in the clamping channel of the flexible safety cap, and about an axis transverse to the longitudinal axis of the object in response to insertion of the object into the clamping channel.

14. The flexible safety cap according to claim 13, wherein the spring elements deform to develop a straight clamping surface against a surface of the object.

15. The flexible safety cap according to claim 5, wherein the flexible safety cap defines a longitudinal axis, and a width of each spring element in the first clamping wall and a width of each spring element in the second clamping wall is measured in a direction of the longitudinal axis of the flexible safety cap, wherein the width of at least one spring element of the first clamping wall is unequal to the width of other spring elements of the first clamping wall, and the width of at least one spring element in the second clamping wall is unequal to the width of other spring elements in the second clamping wall.

* * * * *